United States Patent [19]

Van Praag, III

[11] Patent Number: 5,038,535

[45] Date of Patent: Aug. 13, 1991

[54] FASTENING DEVICE

[76] Inventor: Alex Van Praag, III, P.O. Box 386, Ripon, Calif. 95366

[21] Appl. No.: 370,289

[22] Filed: Jun. 22, 1989

[51] Int. Cl.[5] ..... E04B 2/82

[52] U.S. Cl. ..... 52/127.9; 52/282; 52/584; 52/DIG. 4; 292/202; 292/251.5; 403/DIG. 1

[58] Field of Search ..... 52/285, 282, 127.9, 52/127.10, 105, 584, 582, DIG. 4; 292/201, 251.5; 70/276; 403/DIG. 1

[56] References Cited

U.S. PATENT DOCUMENTS

| | | | |
|---|---|---|---|
| 2,329,815 | 9/1943 | Attwood . | |
| 2,718,424 | 9/1955 | Grierson | 292/201 |
| 2,737,268 | 3/1956 | Smith . | |
| 3,042,978 | 7/1962 | Eames . | |
| 3,290,131 | 12/1966 | Neal, Jr. . | |
| 3,421,459 | 1/1969 | Sherwood . | |
| 3,818,661 | 6/1974 | Van Pragg | 52/282 |
| 4,790,576 | 12/1988 | Higashi | 292/251.5 |
| 4,848,812 | 7/1989 | Slaughter | 70/276 |

FOREIGN PATENT DOCUMENTS

| | | |
|---|---|---|
| 493900 | 6/1953 | Canada . |
| 73151 | 9/1951 | Denmark . |
| 1110457 | 10/1955 | France . |
| 782428 | 9/1957 | United Kingdom . |
| 853581 | 11/1960 | United Kingdom . |

*Primary Examiner*—John E. Murtagh

*Attorney, Agent, or Firm*—Limbach, Limbach & Sutton

[57] ABSTRACT

A method and apparatus for joining building panels, such as portable partitions, walls, floors, ceilings, or roofs. A cam device is located in one panel or member and is magnetically operated to engage a mating element located in an adjacent panel or member.

13 Claims, 4 Drawing Sheets

FASTENING DEVICE

BACKGROUND OF THE INVENTION

1. Field of the Invention

The present invention relates generally to a method and apparatus for building wall construction, and more specifically to a method and apparatus for joining two or more panels together.

2. Description of the Prior Art

A popular method for flexible allocation of space within a building utilizes portable partitions. Further, modular building has gained increased acceptance and usage throughout the construction industry. A standard means for connecting various modules consists of a male locking member attached to one module which must be physically operated through an opening in the module to engage a female receiving element attached to another module. See, for example, Van Praag, U.S. Pat. No. 3,818,661, issued June 25, 1974.

SUMMARY OF THE INVENTION

It is an object of the present invention to provide an improved device for locking building panels together. This and other objects can be achieved by utilizing a cam device which operates upon application of a magnetic force to drive the cam into a locked (or unlocked) position.

The foregoing and other objectives, features and advantages of the invention will be more readily understood upon consideration of the following detailed description of certain preferred embodiments of the invention, taken in conjunction with the accompanying drawings.

Figure 8A:
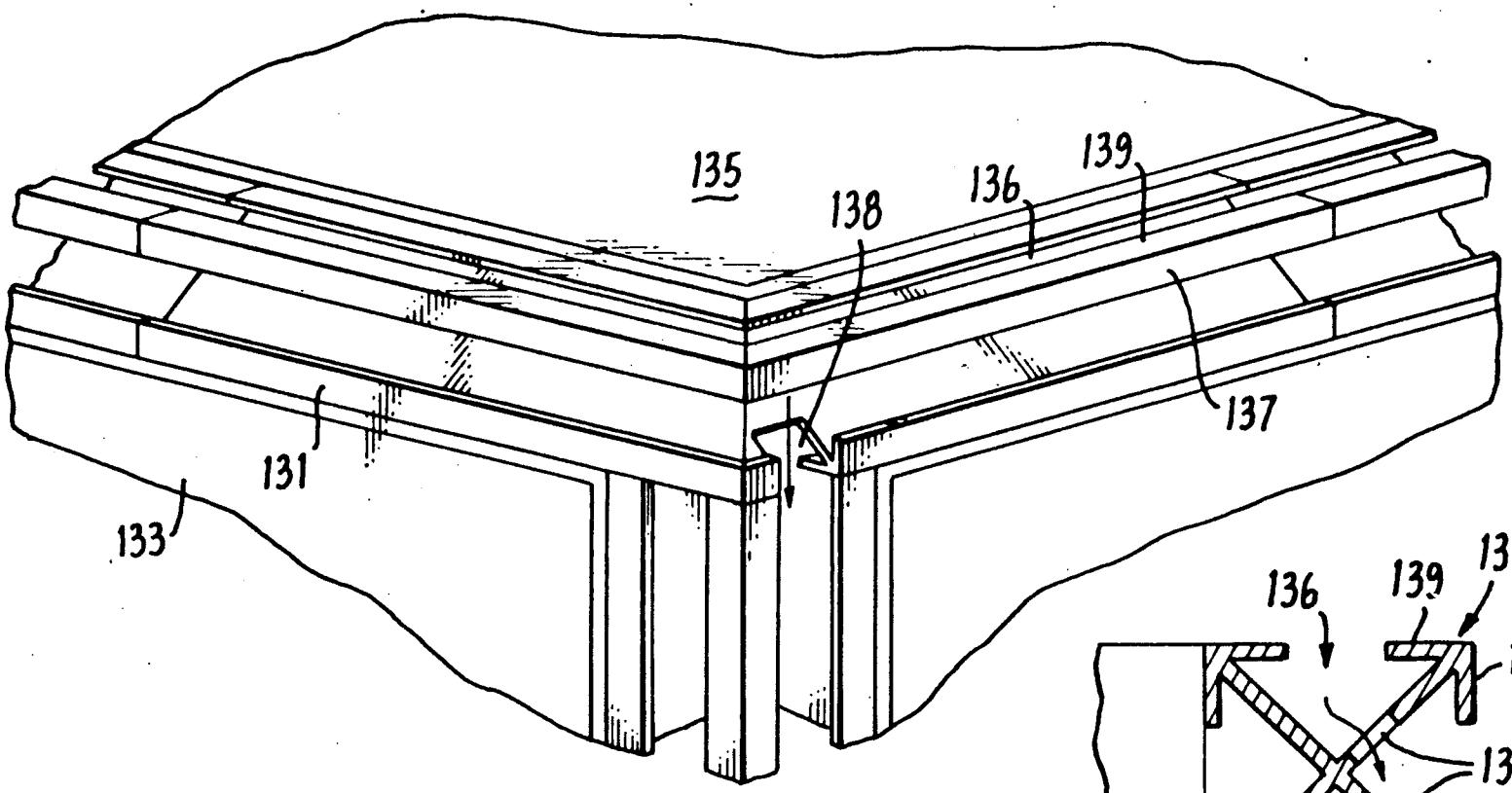

FIG. 8*a* is a perspective view of a typical roof to wall connection to a corner post.

Figure 8B:
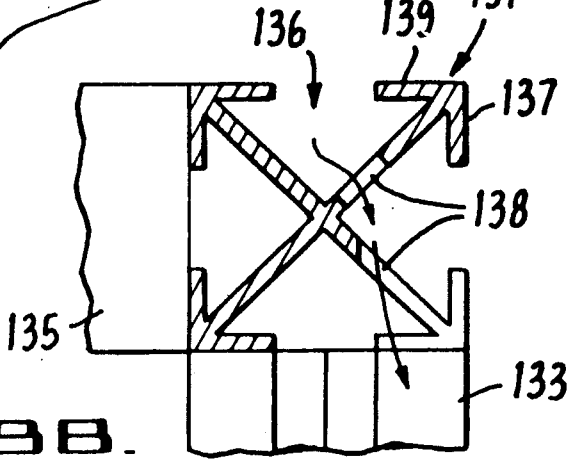

FIG. 8*b* is an enlarged elevational sectional view of a portion of the structure of FIG. 8*a* and illustrates the use of the post to provide a gutterway.

DETAILED DESCRIPTION OF THE INVENTION

Referring to FIGS. 1–4, the basic fastening device of the present invention is illustrated in one particular form thereof. A housing 50 with side panels 50*a* and 50*b* connected by ends 50*c* and 50*d* contains a half-circle plate 47 which is rigidly connected to an axle 49, said axle extending through a pair of gaskets 46 and 48 and then through housing openings 53 and 54. A flange 51 is connected to the circumference of the plate and extends outward from both sides of the plate thus forming a rotating male cam device. The housing 50, plate 47, axle 49 and flange 51 are made of a non-magnetic material, such as injection-molded, glass impregnated nylon. A wedge-shaped magnetic slug 52 is connected to one end of the plate 47 on the inside of the flange 51 such that a magnetic force could be used to attract the slug and effect a rotation of the cam. The housing 50 is typically contained within a wall panel 43. The housing 50 has at least a pair of nubs 55 and 56 extending from the inside of side panel 50*a* of the housing which normally engage corresponding indents 57 and 58 located on one side of the half-circle plate 47. The indents will engage the nubs when the cam is either in the fully engaged or disengaged position.

A typical mating locking member has a locking plate 29 which is held by a pair of springs 31 and 33 connected to opposite ends of the locking plate on the inside of a channel 11. The locking plate 29 is freely movable, but is held in place by said springs 31 and 33 in compression.

The locking plate 29 has an opening 35 therein which serves as a female latching member. The opening 35 is elongated having a pair of projections 37 and 39 extending inwardly of the opening at a position about midway along the length of the opening. Said projections 37 and 39 serve to mate with the male cam element described above, allowing the flange 51 to rotate through the opening 35 and exert a force upon the projections which provides a strong latch between, for example, a wall panel and a structural element.

Figure 1:
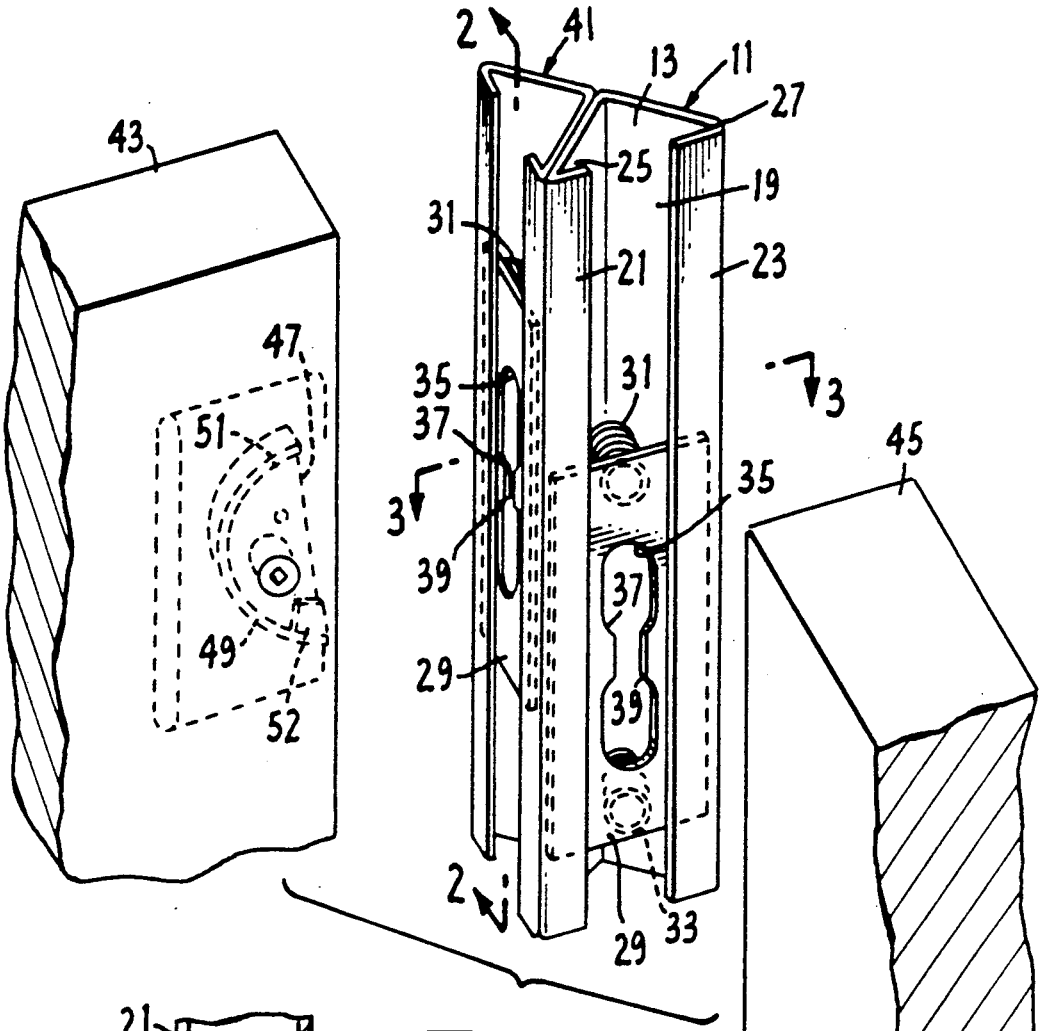
FIG. 1 is a perspective view of the improved fastening pictured in connection with a pair of panels to together by a mating device.
Figure 2:
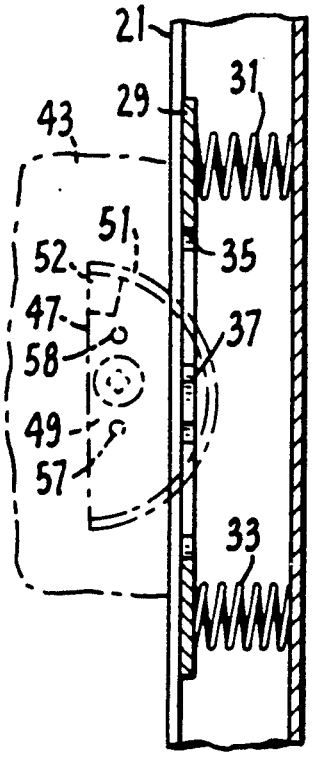
FIG. 2 is a side view of the improved fastening device installed in a wall panel and engaged with a mating device of FIG. 1 taken across section 2—2.
Figure 3:
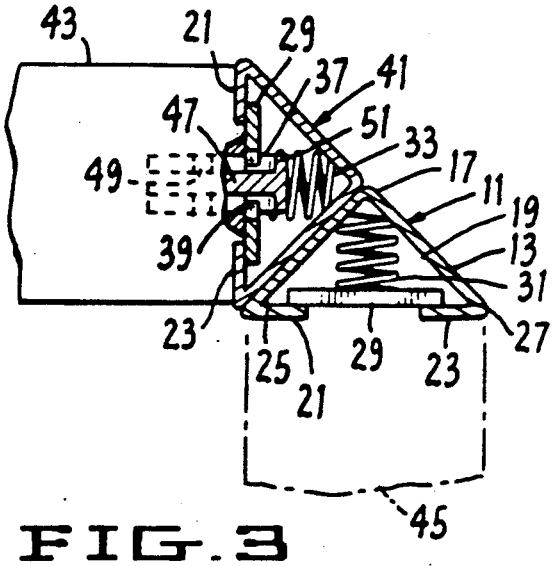
FIG. 3 is a top view of the improved fastening device installed in a wall panel and engaged with a mating device of FIG. 1 taken across section 3—3.
Figure 4:
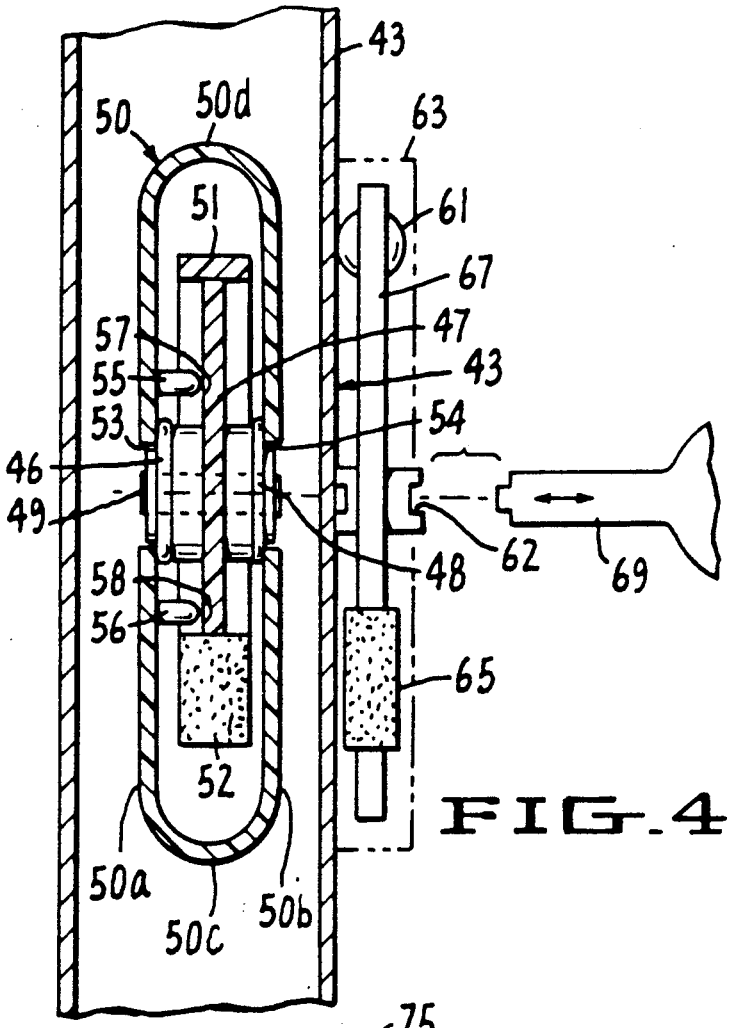
FIG. 4 is a sectional view of the fastening device and positioner in relation to a typical building panel.

The operation of the male cam element can be seen by reference to FIG. 4. A positioning device consists of a housing 63 which contains a rotatable ring 67 having a series of load transfer rolling balls 61 and a magnet 65 mounted radially in a position corresponding to the position of the magnetic slug on plate 47. The positioner housing 63 is placed against the wall panel 43 at a position relative to the location of the cam housing 50 inside the wall panel so that the plate 47 and ring 67 are axially aligned. The magnet 65 exerts a magnetic force which attracts the magnetic slug 52, thus compressing the o-ring 48 and drawing the entire plate 47 along an axial line toward the positioner 63, thereby releasing the nubs 55 and 56 from the indents 57 and 58. With the plate 47 thus freed from its secure position, a screw gun 69 is applied to an opening 62 in the positioner 63 in order to rotate the positioning ring 61 and magnet 65. The magnetic slug 52 follows the magnetic force of the magnet about the axle 49, thus allowing the cam to engage or disengage the locking plate 29, as described above. Removing the positioning device 63 relaxes the plate 47 into its centralized neutral position within the housing 50 thus re-engaging the nubs 55 and 56 with the indents 57 and 58 and locking the cam in position.

The flexibility of this fastening system can be further understood through additional illustrations provided hereinafter.

Figure 5:
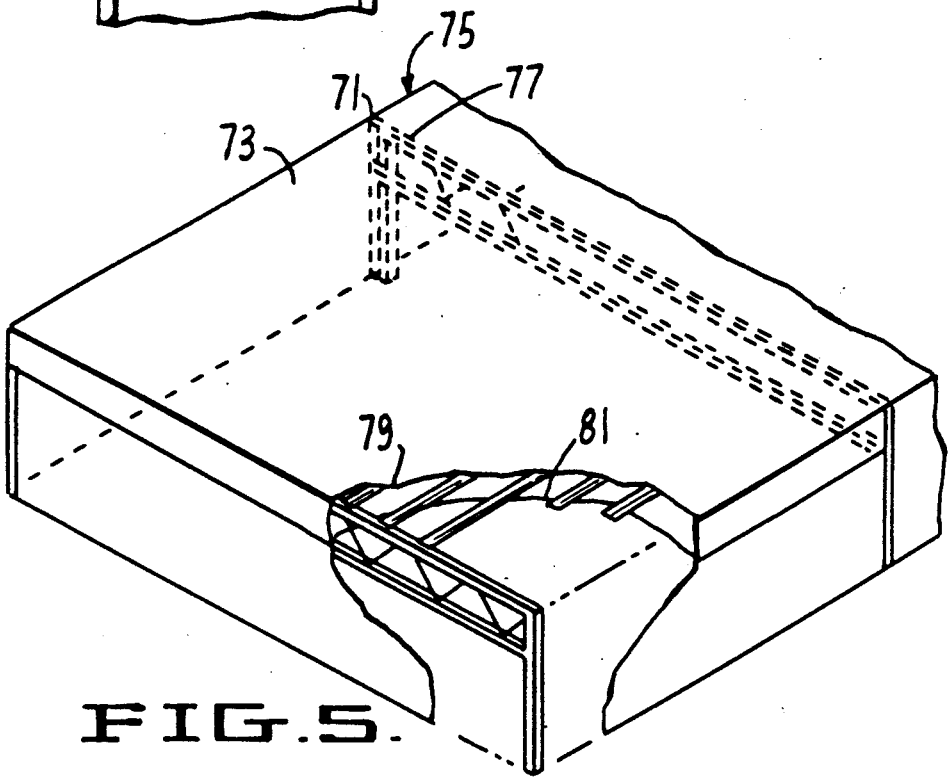
FIG. 5 is a perspective view of the present invention as used to support a long span.

Referring to FIG. 5, it can be seen that long spans can be accommodated through use of the fastening system. A framing post 71 provides a mating locking member of the type illustrated in FIG. 1 for latching wall panels 73 and 75 and a support beam 77. The post and beam may be composed of pultruded high strength fiberglass. Roof panels 79 and ceiling panels 81 are similarly mated to the support beam 77.

Figure 6:
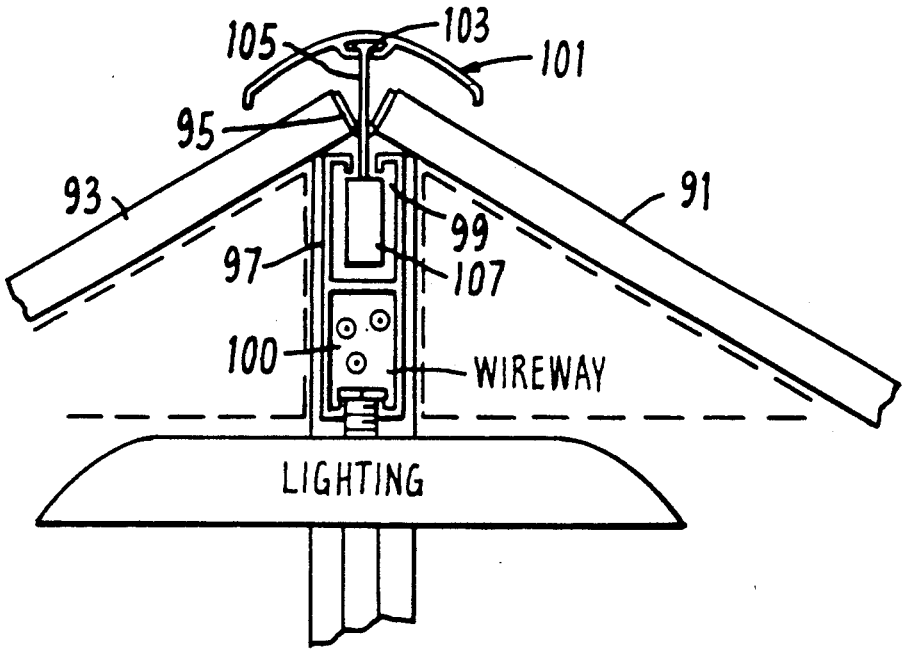
FIG. 6 illustrates the use of the fastening device in a pitch roof ridge.

Referring to FIG. 6, a method for connecting a roof or ceiling ridge is shown. A pair of panels 91 and 93 at a pitch angle are locked together by hinge 95. A double-strut-type support beam 97 runs the length of the ridge and contains channels 99 and 100. A ridge plate 101 contains an interior slot 103 in which a tie-down rod 105 is secured. The tie-down rod 105 is pulled securely against the panels 91 and 93 by means of a male cam locking device 107 located within the channel 99. Channel 100 is empty and may be used, for example, as a wireway.

Figure 7:
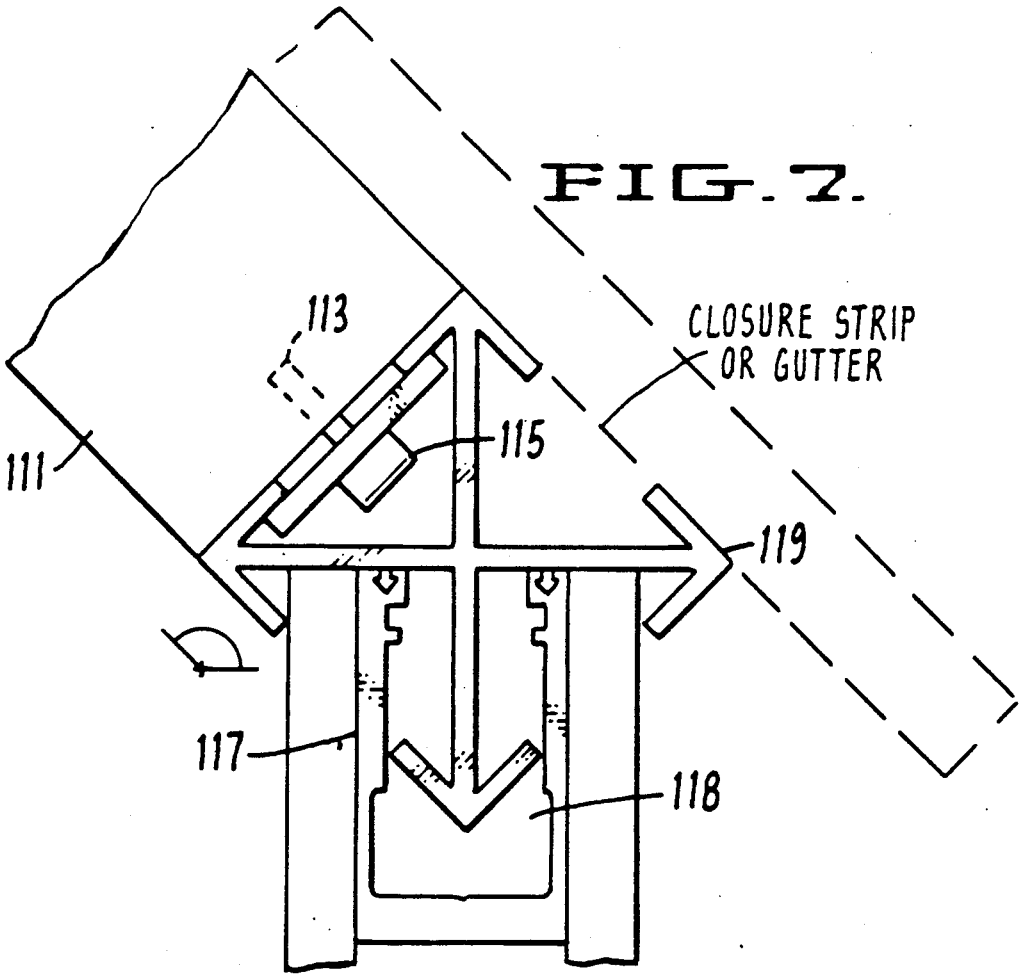
FIG. 7 illustrates use of the invention to effect a roof to wall connection.

Referring to FIG. 7, a method for connecting a pitch roof to a wall panel is shown. A roof panel 111 has a locking device 113 contained therein such as contained in housing 50 described above which mates with a locking plate 115, similar to locking plate 29, contained within a horizontal member 119 in a manner described hereinabove. A wall panel 117 has a slot 118 into which the horizontal member 119 fits snugly or can be locked with locking plates similar to plates 47 and 29. The angle between the wall and roof may be altered by modifying the horizontal member. Referring to FIGS. 8*a* and 8*b*, a method for providing an integral gutter system is shown. While the post 131 serves to mate and lock the wall panel 133 and the ceiling panel 135 with locking plates (not shown) similar to plates 47 and 29, there are spare channels 137 and 139 which may serve as a natural gutterway 136 or for wiring or similar needs. The gutterway 136 has a drain cutout 138. While the particular embodiments described have many advantages, it should be understood that the scope of the present invention is not necessarily limited by those details described above, but includes other structures using the novel features hereinafter defined by the claims.

I claim:

1. A construction fastening device of the type which would engage a mating device upon application of engaging means, comprising:

(a) a cam device, further comprising:

i) a half-circle plate having a front and back side, said plate being rigidly mounted upon an axle;

ii) a flange rigidly connected to and extending from both sides of said plate along the full circumference of the plate;

iii) a magnetic slug which is rigidly attached to said plate at one end of said flange;

(b) a first housing in which said cam device is contained, said housing having two broad sides separated by four narrower sides, one of said narrower sides being opened such that said cam device can extend therefrom when operated, each of said broad sides having a round opening centrally located such that said axle fits loosely thereinto and having a gasket fitted between said axle and opening;

(c) means for securing said half-circle plate against said first housing when cam device and mating device are in either the engaged or disengaged position.

2. A construction fastening device, comprising:

(a) a cam device, further comprising:

i) a half-circle plate having a front and back side, said plate being rigidly mounted upon an axle;

ii) a flange rigidly connected to and extending from both sides of said plate along the full circumference of the plate;

iii) a magnetic slug which is rigidly attached to said plate at one end of said flange;

(b) a first housing in which said cam device is contained, said housing having two broad sides separated by four narrower sides, one of said narrower sides being opened such that said cam device can extend therefrom when operated, each of said broad sides having a round opening centrally located such that said axle fits loosely thereinto and having a gasket fitted between said axle and opening;

(c) a mating locking element;

(d) means for rotating said cam device so that said flange may engage or disengage said mating locking element;

(e) means for securing said half-circle plate against said first housing when cam device and mating element are in either the engaged or disengaged position.

3. A construction fastening device according to claim 2, wherein said plate, axle, flange, gasket and first housing are made of non-magnetic materials.

4. A construction fastening device according to claim 3, wherein said plate, axle, flange and housing are made of injection-molded glass impregnated nylon.

5. A construction fastening device according to claim 3, wherein said rotating means is a positioner device, comprising:

(a) a position marker;

(b) a magnet;

(c) a rotatable ring upon which said position marker and magnet are affixed;

(d) means for turning said ring about an axial position;

(e) a second housing in which said ring, position marker and magnet are contained, and which has an opening into which said turning means may be applied to turn the ring about a perpendicular central axis.

6. A construction fastening device according to claim 5, wherein said securing means comprises:

(a) a plurality of nubs located on the inside face of one of said broad sides of said first housing;

(b) a plurality of indents located on one side of said half-circle plate corresponding to said nubs, whereby said nubs fit snuggle, into said indents when said cam device is in either a fully open (disengaged from mating locking element) or fully closed (engaged to mating locking element) position, and whereby said indents are lifted out and away from said nubs so that cam device may be rotated to its opposite position by placing said positioner device in the proximity of said first housing on the side opposite said nubs and indents and allowing the operation of a magnetic force of said magnet upon said magnetic slug so that said half-circle plate is drawn toward the magnetic force.

7. A construction fastening device according to claim 6, further comprising a first building panel in which said first housing is contained.

8. A construction fastening device according to claim 6, further comprising a first building structural element in which said first housing is contained.

9. A construction fastening device according to claim 7, further comprising a second building structural element in which said mating locking element is contained.

10. A construction fastening device according to claim 8, further comprising a second building panel in which said mating locking element is contained.

11. A construction fastening device according to claims 7 or 10, wherein said first and second building panels are composed of non-magnetic material.

12. A construction fastening device according to claims 8 or 9, wherein said first and second building structural elements are composed of non-magnetic material.

13. A construction fastening device according to claims 8 or 9, wherein said first and second building structural elements are composed of pultruded high strength fiberglass.

* * * * *